US007458664B2

(12) United States Patent
Sato

(10) Patent No.: US 7,458,664 B2
(45) Date of Patent: Dec. 2, 2008

(54) LIQUID EJECTION APPARATUS

(75) Inventor: Seiya Sato, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 469 days.

(21) Appl. No.: 11/374,030

(22) Filed: Mar. 14, 2006

(65) Prior Publication Data

US 2006/0214999 A1 Sep. 28, 2006

(30) Foreign Application Priority Data

Mar. 15, 2005 (JP) ..... 2005-073794

(51) Int. Cl.
*B41J 2/17* (2006.01)

(52) U.S. Cl. ..... 347/84; 347/17

(58) Field of Classification Search ..... 347/20, 347/56, 65, 66, 67, 17, 84–87
See application file for complete search history.

(56) References Cited

U.S. PATENT DOCUMENTS 7,168,795 B2 * 1/2007 Shimizu ..... 347/84
2004/0141023 A1 7/2004 Nakamura ..... 347/30
2005/0007399 A1 1/2005 Harvey et al. ..... 347/6

FOREIGN PATENT DOCUMENTS

| | | | |
|---|---|---|---|
| DE | 3604578 | A1 | 11/1986 |
| JP | 2000-246950 | A | 9/2000 |
| JP | 2004-142405 | A | 5/2004 |
| JP | 2004-249560 | A | 9/2004 |

* cited by examiner

*Primary Examiner*—Juanita D Stephens
(74) *Attorney, Agent, or Firm*—Sughrue Mion, PLLC

(57) ABSTRACT

A liquid ejection apparatus for accurately supplying a plurality of nozzle rows with liquid having an adjustable hydrodynamic flow pressure to eject the liquid. Black ink, cyan ink, magenta ink, and yellow ink are supplied to first to fourth valve units through first to fourth branch passages. Each ink is then supplied to nozzle rows of a recording head after the hydrodynamic flow pressure of the ink is adjusted. The hydrodynamic flow pressure of the ink supplied to each nozzle row is prevented from fluctuating. The liquid ejection apparatus accurately ejects ink from each nozzle row and improves the reliability of performing recording on a recording sheet.

10 Claims, 6 Drawing Sheets

LIQUID EJECTION APPARATUS

CROSS-REFERENCE TO RELATED APPLICATIONS

This application is based upon and claims the benefit of priority from prior Japanese Patent Application No. 2005-73794, filed on Mar. 15, 2005, the entire contents of which are incorporated herein by reference.

BACKGROUND

The present invention relates to a liquid ejection apparatus for supplying a liquid having an adjusted hydrodynamic flow pressure to rows of liquid ejection nozzles.

An inkjet recording apparatus is known as a liquid ejection apparatus. The inkjet recording apparatus ejects ink contained in an ink cartridge from a recording head through rows of nozzles to form dots of ink on a recording medium.

JP-A-2004-142405 describes an off-carriage inkjet recording apparatus having an off-carriage ink supply. The off-carriage inkjet recording apparatus includes a pressurizing pump for generating compressed air. The pressurizing pump pressurizes an ink pack accommodated in an ink cartridge with the compressed air. The ink contained in the pressurized ink pack is supplied to a recording head through a supply passage.

The inkjet recording apparatus described in the above publication includes a plurality of valve units respectively connected to a plurality of supply passages communicating with a plurality of ink cartridges. Each ink cartridge contains ink of a different color. Each valve unit includes a diaphragm that opens when subjected to a predetermined pressure. The opening and closing of the diaphragm adjusts the hydrodynamic flow pressure of the ink. The ink having the adjusted hydrodynamic flow pressure is supplied to the recording head.

To increase the accuracy of the dots formed on a recording medium, a recent inkjet recording apparatus has a recording head including rows of nozzles for ejecting ink of the same color. However, the inkjet recording apparatus described in the above publication uses a single valve unit to supply ink having an adjusted hydrodynamic flow pressure to the nozzle rows. Thus, if the quantity of the nozzle rows in the inkjet recording apparatus of the above publication increases, it may become difficult to accurately supply each nozzle row with ink having the adjusted hydrodynamic flow pressure. For this reason, the inkjet recording apparatus described in the above publication cannot have a recording head including a plurality of nozzle rows for ejecting ink of the same color.

SUMMARY

It is an object of the present invention to provide a liquid ejection apparatus for accurately supplying a plurality of nozzle rows with a liquid having an adjusted hydrodynamic flow pressure.

According to a first aspect of the invention, there is provided a liquid ejection apparatus for ejecting liquid contained in a liquid source. The liquid ejection apparatus includes a supply passage connected to the liquid source. A liquid ejection head is connected to the supply passage and includes a plurality of nozzles for ejecting the liquid. The plurality of nozzles form a plurality of nozzle rows. A plurality of branch passages, connected to the supply passage, receive the liquid from the supply passage and supply the liquid to two or more of the plurality of nozzle rows. A hydrodynamic flow pressure adjusting unit adjusts hydrodynamic flow pressure of the liquid flowing through each branch passage.

According to a second aspect of the invention, there is provided a liquid ejection apparatus for use with a plurality of liquid sources respectively containing liquids. The liquid ejection apparatus includes a reciprocally moveable carriage remote from the liquid sources and a plurality of liquid passages respectively connected to the plurality of liquid sources. The liquids respectively flow through the plurality of liquid passages. A plurality of branch passages are respectively connected to the plurality of liquid passages. Each of the liquids flows through at least two of the branch passages. A liquid ejection head is supported by the reciprocally moveable carriage and includes a plurality of nozzle rows respectively connected to the plurality of branch passages. The at least two of the branch passages are respectively connected to at least two of the nozzle rows. One of the liquids is ejected from the at least two of the nozzle rows. A plurality of valve units are supported by the reciprocally moveable carriage and are respectively associated with the plurality of branch passages. Each of the plurality of valve units adjusts hydrodynamic flow pressure of the liquid flowing through the associated branch passage.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

A preferred embodiment of the present invention will now be described with reference to FIGS. 1 to 7.

Figure 1:
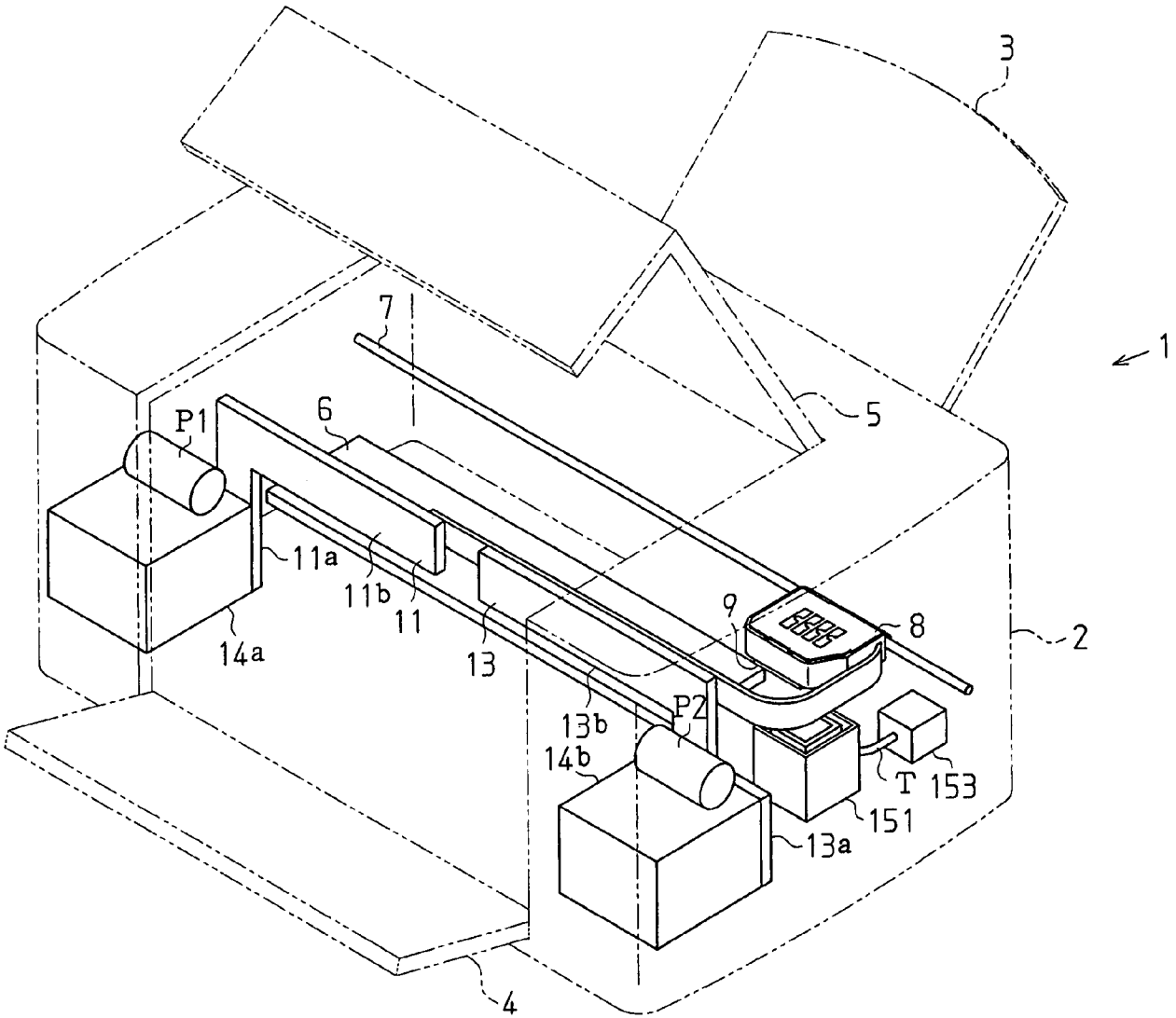
FIG. 1 is a perspective view showing a printer according to a preferred embodiment of the present invention.

FIG. 1 shows a printer 1, which functions as a liquid ejection apparatus. A frame 2 includes a rear surface to which a paper feed tray 3 is attached, a front surface to which a paper ejection tray 4 is attached, and a top surface to which a printer cover 5 is attached. Hinges enable the paper ejection tray 4 and the printer cover 5 to open and close. The user has access to the inside of the frame 2 when the paper ejection tray 4 and the printer cover 5 open.

A platen 6 is arranged in the frame 2. A paper feed mechanism (not shown) feeds a recording sheet from the paper feed tray 3 onto the platen 6, and ejects the recording sheet onto the ejection tray 4. A guide rod 7 extends parallel to the platen 6 in the frame 2. A carriage 8 is supported on the guide rod 7 and is moveable along the guide rod 7. The carriage 8 is connected to a drive mechanism (not shown) arranged in the frame 2. The drive mechanism includes a carriage motor, a pair of pulleys, and a timing belt. The carriage 8 is driven by the drive mechanism and reciprocates along the guide rod 7, that is, in parallel with the platen 6.

The carriage 8 supports a recording head 9, which functions as a liquid ejection head. The recording head 9 has a nozzle surface 10 arranged to face a recording sheet fed onto the platen 6. The nozzle surface 10 includes a plurality of nozzle rows N1 to N8 (refer to FIG. 2). Each of the nozzle rows N1 to N8 is formed by n liquid ejection nozzles (n is a natural number).

Passage plates 11 and 13 are arranged between the platen 6 and the paper ejection tray 4 in the frame 2. The passage plates 11 and 13 are formed by bent rigid plates. The rigid plate of the passage plate 11 includes a coupler plate 11*a* and a flat arm 11*b*. The rigid plate of the passage plate 13 includes a coupler plate 13*a* and a flat arm 13*b*. The coupler plates 11*a* and 13*a* function as attachment portions. The flat arm 11*b* extends from the coupler plate 11*a* toward the middle of the frame 2. The flat arm 13*b* extends from the coupler plate 13*a* toward the middle of the frame 2.

Figure 2:
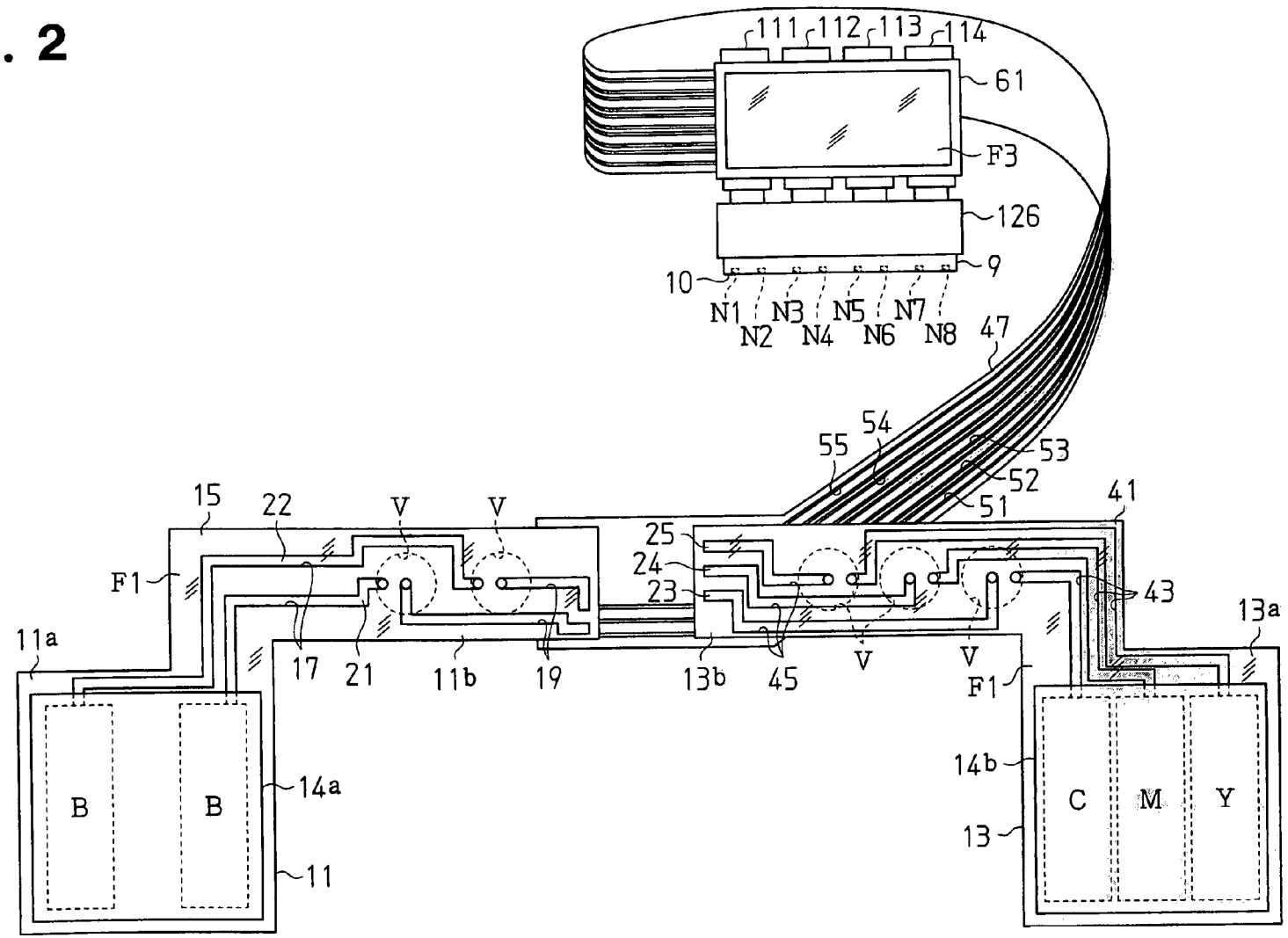
FIG. 2 is a front view showing passage plates of the printer.
Figure 3:
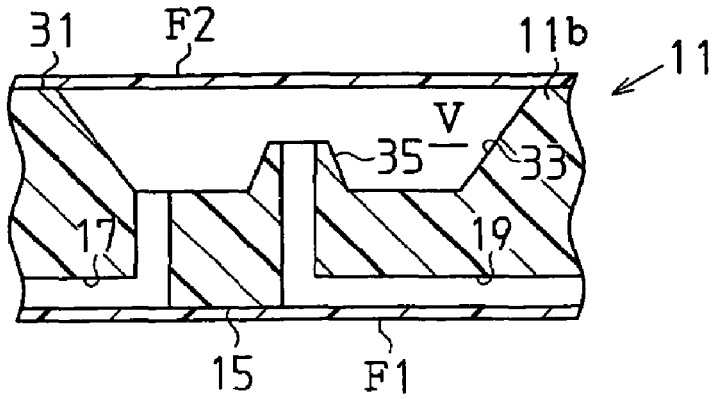
FIG. 3 is a cross-sectional view of a choke valve.

As shown in FIG. 2, first and second rigid passages 21 and 22 are formed on a front surface 15 of the passage plate 11. Each of the first and second rigid passages 21 and 22 is formed by a first groove 17 and a second groove 19. Each first groove 17 extends from the coupler plate 11*a* to the arm 11*b*. Each second groove 19 extends from the middle of the arm 11*b* to a distal end of the arm 11*b*. As shown in FIG. 3, a film F1 is adhered to the front surface 15 of the arm 11*b*, and a film F2 is adhered to a rear surface 31 of the arm 11*b*. The film F1 on the front surface 15 prevents leakage of ink from the first and second rigid passages 21 and 22.

Two choke valves v are arranged in the rear surface 31 of the arm 11*b* of the passage plate 11. The two choke valves V communicate with parts of the first and second rigid passages 21 and 22. Each choke valve V includes a circular groove 33 formed in the rear surface 31, a central projection 35 surrounded by the groove 33, and the film F2 adhered to the rear surface 31. Each first groove 17 communicates with the groove 33 of a corresponding one of the choke valves V. Each second groove 19 communicates with the central projection 35 of the corresponding one of the choke valves V. The openings of the second grooves 19 are closed to shut the first and second rigid passages 21 and 22 when the choke valves V function to bring its films F2 in contact with the central projections 35. The openings of the second grooves 19 are open to the first and second rigid passages 21 and 22 when the choke valves V function to space the films F from the central projections 35.

As shown in FIG. 2, third to fifth rigid passages 23 to 25 are formed on a front surface 41 of the passage plate 13. Each of the third to fifth rigid passages 23 to 25 is formed by a third groove 43 and a fourth groove 45. Each third groove 43 extends from the coupler plate 13*a* to the arm 13*b*. Each fourth groove 45 extends from a middle position of the arm 13*b* to a distal end of the arm 13*b*. Three choke valves V are arranged in a rear surface of the arm 13*b*. The three choke valves V communicate with parts of the third to fifth rigid passages 23 to 25. The other parts of the passage plate 13 is substantially the same as the corresponding structure of the passage plate 11.

Cartridge holders 14*a* and 14*b* are respectively connected to the coupler plates 11*a* and 13*a*. The cartridge holder 14*a* detachably holds two ink cartridges (black cartridges B) containing black ink. The cartridge holder 14*b* detachably holds three ink cartridges (i.e., a cyan cartridge C, a magenta cartridge M, and a yellow cartridge Y) respectively containing cyan ink, magenta ink, and yellow ink. Therefore the ink cartridges B, C, M, and Y are detachable from the passages 21 to 25 and 51 to 55. Each ink cartridge may be an ink pack. The ink cartridges or the ink packs function as liquid sources.

In the preferred embodiment, the printer 1 is an off-carriage printer. Pressurizing pumps P1 and P2, functioning as compressed air generation unit, are arranged in the frame 2. The pressurizing pumps P1 and P2 supply compressed air to the black cartridge B, the cyan cartridge C, the magenta cartridge M, and the yellow cartridge Y in order to supply the first to fifth rigid passages 21 to 25 with ink. For example, black ink is supplied from the black cartridge B to the first and second rigid passages 21 and 22. Cyan ink is supplied from the cyan cartridge C to the third rigid passage 23. Magenta ink is supplied from the magenta cartridge M to the fourth rigid passage 24. Yellow ink is supplied from the yellow cartridge Y to the fifth rigid passage 25.

As shown in FIGS. 1 and 2, a bundle 47 of flexible tubes or belts (tube bundle 47) connects the passage plates 11 and 13 to a socket or a branch passage assembly 61, which is arranged in the carriage 8. The distal end of the tube bundle 47 is connected to the branch passage assembly 61 through an insertion hole formed in the carriage 8. The basal end of the tube bundle 47 is connected to the distal ends of the arms 11*b* and 13*b*. The tube bundle 47 includes first to fifth flexible passages 51 to 55 that communicate with the first to fifth rigid passages 21 to 25, respectively. The inks supplied from the black cartridge B flow to the first and second flexible passages 51 and 52, the ink supplied from the cyan cartridge C flows to the third flexible passage 53, the ink supplied from the magenta cartridge M flows to the fourth flexible passage 54, and the ink supplied from the yellow cartridge Y flows to the fifth flexible passage 55.

Figure 4:
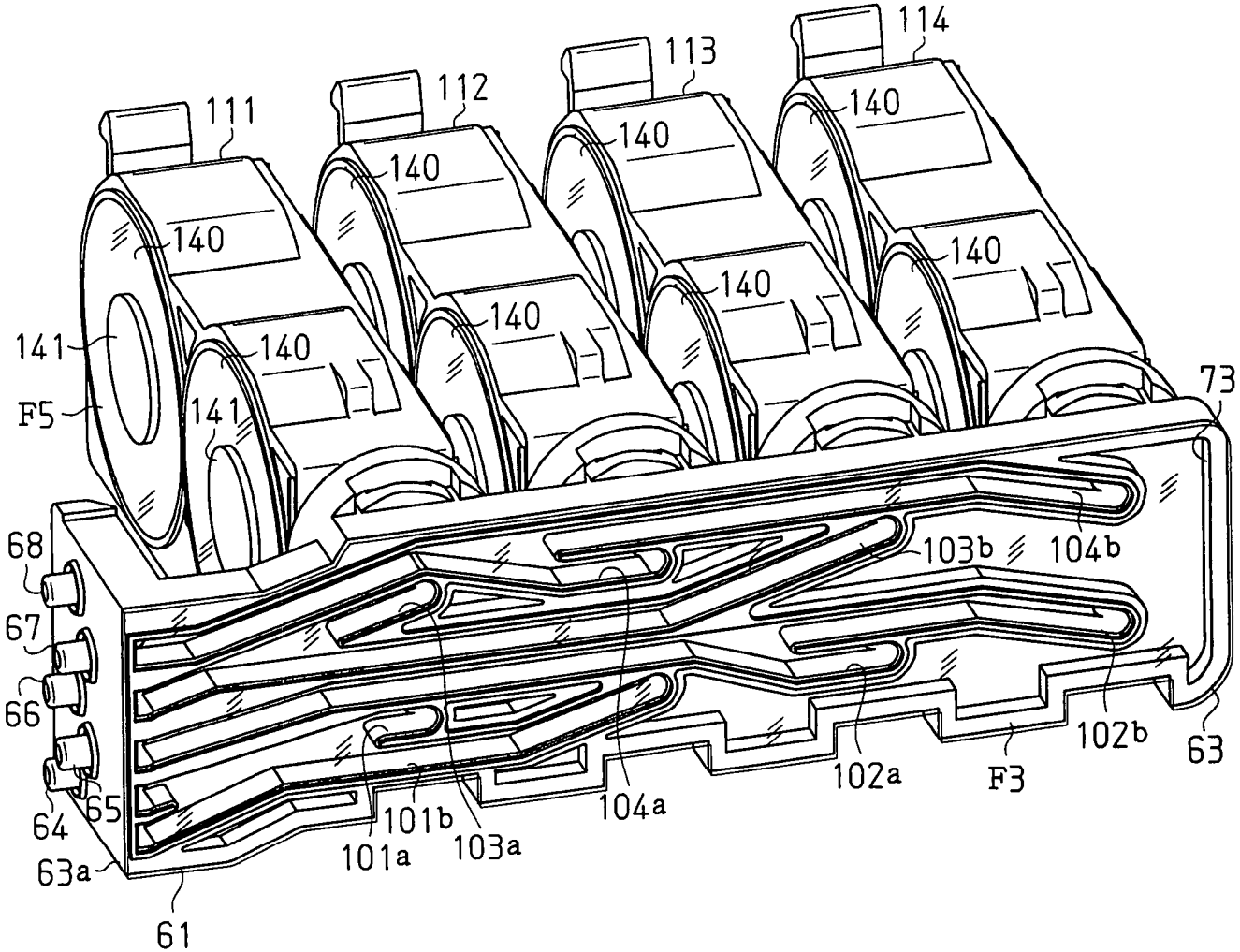
FIG. 4 is a perspective view showing a branch passage assembly.
Figure 5:
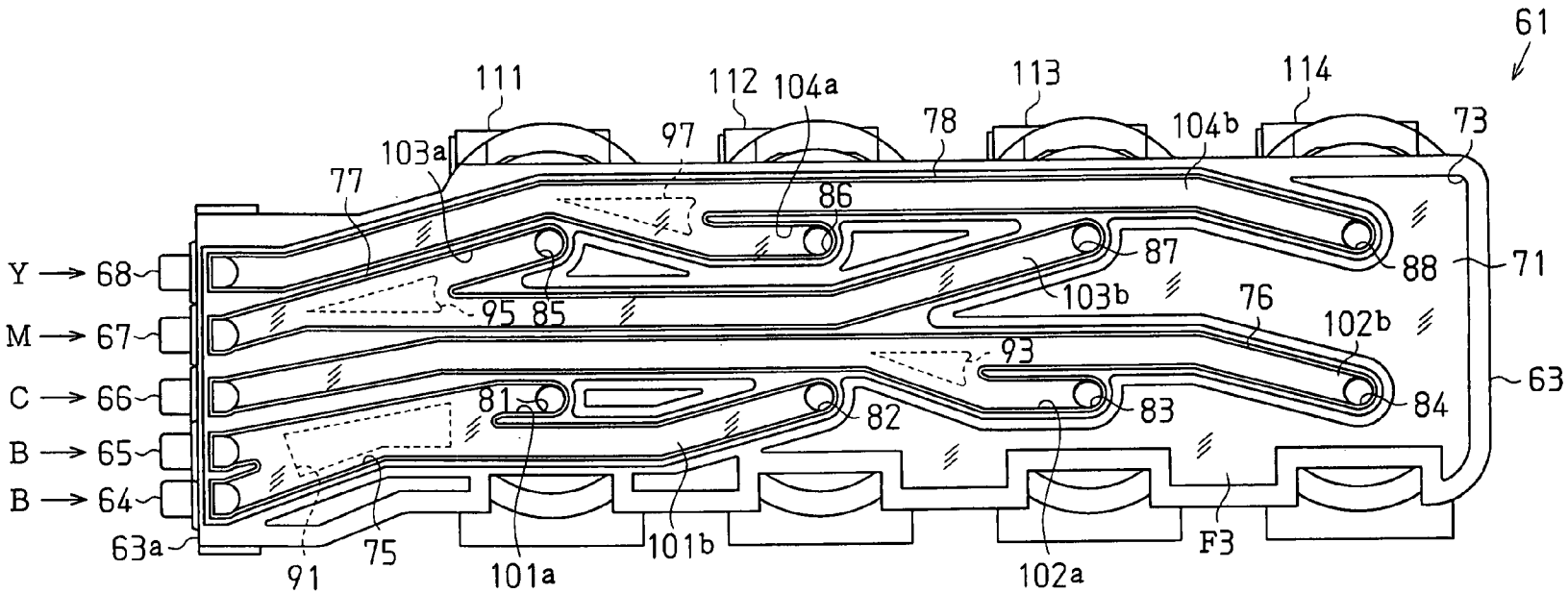
FIG. 5 is a front view showing the branch passage assembly.

As shown in FIGS. 4 and 5, the branch passage assembly 61 includes a case 63 and a film F3. The case 63 is thin box-shaped. The film F3 is adhered to a front surface 71 of the case 63. The case 63 includes a connection side surface 63*a* on which cylindrical first to fifth connection terminals 64 to 68 are formed. The first to fifth connection terminals 64 to 68 are respectively connected to the first to fifth flexible passages 51 to 55 of the tube bundle 47. The front surface 71 of the case 63 has a rectangular recession region 73, which is defined by an outer edge rib of the case 63. The case 63 includes first to fourth branching grooves 75 to 78 in the recession region 73. The first to fourth branching grooves 75 to 78 are defined by walls continuously extending from the outer edge rib of the case 63. The first to fourth branching grooves 75 to 78 communicate with the first to fifth flexible passages 51 to 55 of the tube bundle 47 via the first to fifth connection terminals 64 to 68, respectively.

First to eighth communication holes 81 to 88 are formed in the first to fourth branching grooves 75 to 78. The first to eighth communication holes 81 to 88 respectively communicate with eight hollow needles (not shown), which are arranged on the rear surface of the branch passage assembly 61. The line of the first to fourth communication holes 81 to 84 may be parallel to the line of the fifth to eighth communication holes 85 to 88.

As shown in FIG. 5, the first branching groove 75 includes first branch passages 101*a* and 10*b*. The second branching groove 76 includes second branch passages 102*a* and 102*b*. The third branching groove 77 includes third branch passages 103*a* and 103*b*. The fourth branching groove 78 includes fourth branch passages 104*a* and 104*b*.

The first branching groove 75 has two inlets that communicate with the first and second connection terminals 64 and 65, respectively. The black ink flows into the first branching groove 75 through the two inlets, and the two flows of black ink join each other at a middle portion 91. The ink, which is then branched into two, flows through the first branch passages 101*a* and 101*b* and out of the first and second communication holes 81 and 82.

The second branching groove 76 has an inlet that communicates with the third connection terminal 66. The cyan ink flows into the second branching groove 76 through the inlet and branches into two at a middle portion 93. The ink then flows through the second branch passages 102*a* and 102*b* and out of the third and fourth communication holes 83 and 84.

The third branching groove 77 has an inlet that communicates with the fourth connection terminal 67. The magenta ink flows into the third branching groove 77 through the inlet and branches into two at a middle portion 95. The ink then flows through the third branch passages 103*a* and 103*b* and out of the fifth and seventh communication holes 85 and 87.

The fourth branching groove 78 has an inlet that communicates with the fifth connection terminal 68. The yellow ink flows into the fourth branching groove 78 through the inlet and branches into two at a middle portion 97. The ink then flows through the fourth branch passages 104*a* and 104*b* and out of the sixth and eighth communication holes 86 and 88.

The film F3 adhered to the case 63 prevents liquid leakage from the branch passages 101*a* to 104*b*. The first to fifth rigid passages 21 to 25 and the first to fifth flexible passages 51 to 55 function as supply passages. The passage plates 11 and 13 and the case 63 function as passage formation members.

Figure 6:
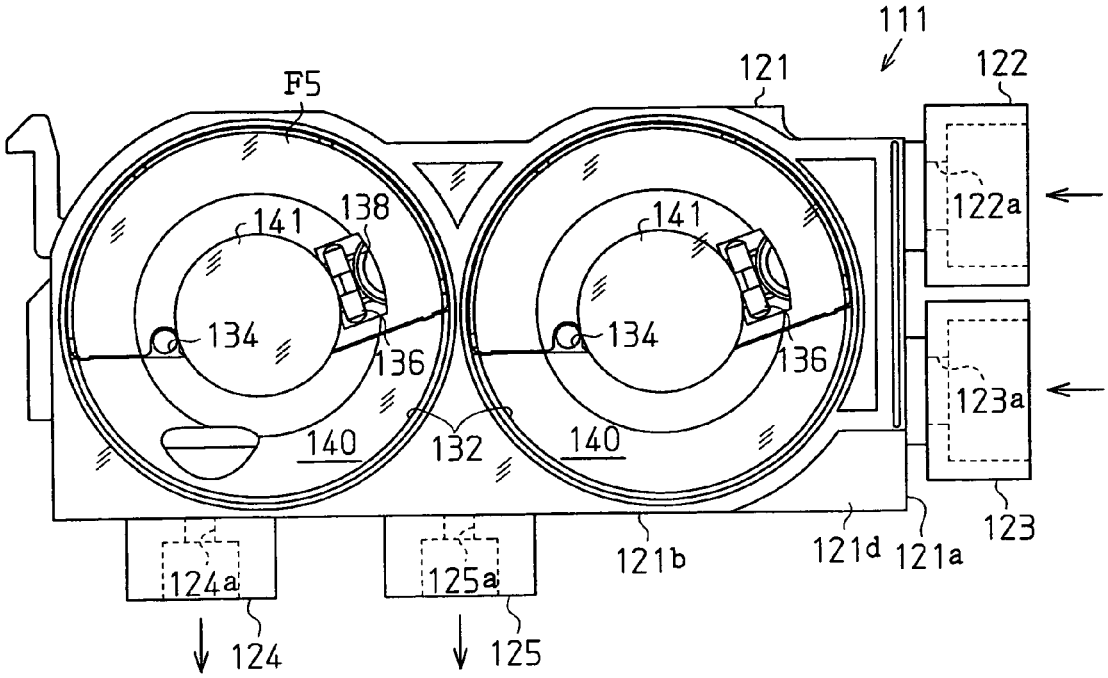
FIG. 6 is a front view showing a valve unit.
Figure 7:
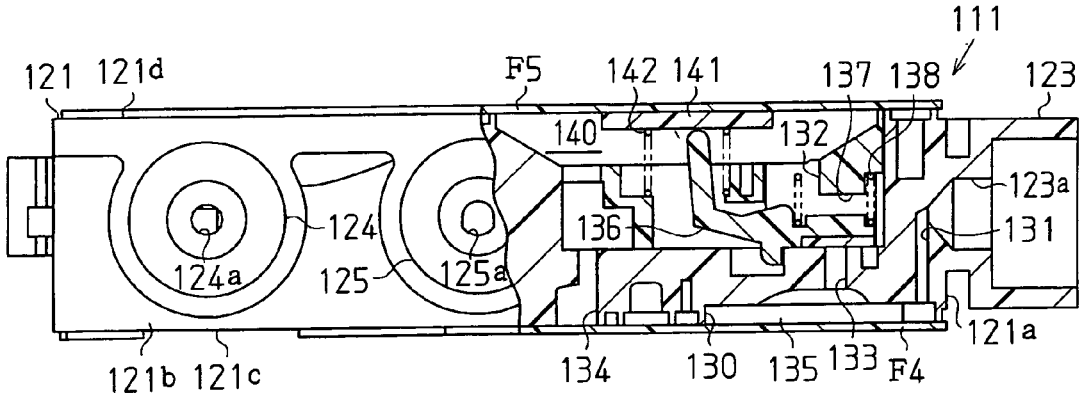
FIG. 7 is a partial cross-sectional view of the valve unit.

Referring to FIG. 4, the hollow needles arranged on the rear surface of the branch passage assembly 61 are connected to first to fourth valve units 111 to 114 functioning as hydrodynamic flow pressure adjusting unit that adjust hydrodynamic flow pressure. FIGS. 6 and 7 show the first valve unit 111. The second to fourth valve units 112 to 114, which have the same structure as the first valve unit 111, are not shown in the drawings and will not be described. The first valve unit 111 includes a housing 121, which is thin box-shaped. The housing 121 has a front surface 121*a* and a bottom surface 121*b*. Two cylindrical ports, that is, first and second inlet ports 122 and 123, are formed on the front surface 121*a*. Two cylindrical ports, that is, first and second outlet ports 124 and 125, are formed on the bottom surface 121*b*.

The first inlet port 122 has an inlet hole 122*a*. The second inlet port 123 has an inlet hole 123*a*. The first outlet port 124 has an outlet hole 124*a*. The second outlet port 125 has an outlet hole 125*a*. The hollow needles (not shown) of the branch passage assembly 61 are inserted in the inlet holes 122*a* and 123*a*. When the first to fourth valve units 111 to 114 are attached to the branch passage assembly 61, the first inlet port 122 and the second inlet port 123 of the first valve unit 111 respectively communicate with the fifth communication hole 85 and the first communication hole 81, the first inlet port 122 and the second inlet port 123 of the second valve unit 112 respectively communicate with the sixth communication hole 86 and the second communication hole 82, the first inlet port 122 and the second inlet port 123 of the third valve unit 113 respectively communicate with the seventh communication hole 87 and the third communication hole 83, and the first inlet port 122 and the second inlet port 123 of the fourth valve unit 114 respectively communicate with the eighth communication hole 88 and the fourth communication hole 84.

The second inlet ports 123 of the first and second valve units 111 and 112 communicate with the first branch passages 101*a* and 101*b*, the second inlet ports 123 of the third and fourth valve units 113 and 114 communicate with the second branch passages 102*a* and 102*b*, the first inlet ports 122 of the first and third valve units 111 and 113 communicate with the third branch passages 103*a* and 103*b*, and the first inlet ports 122 of the second and fourth valve units 112 and 114 communicate with the fourth branch passages 104*a* and 104*b*.

The black ink flows into the second inlet ports 123 of the first and second valve units 111 and 112. The cyan ink flows into the second inlet ports 123 of the third and fourth valve units 113 and 114. The magenta ink flows into the first inlet ports 122 of the first and third valve units 111 and 113. The yellow ink flows into the first inlet ports 122 of the second and fourth valve units 112 and 114.

The carriage 8 includes a connection terminal member 126, which is connected to the valve units 111 to 114. The connection terminal member 126 includes eight supply needles (not shown), which are inserted in the outlet holes 124*a* and 125*a* of the first and second outlet ports 124 and 125 of the valve units 111 to 114. The eight supply needles of the connection terminal member 126 communicate with the nozzle rows N1 to N8 of the recording head 9, respectively. The two outlet ports 124 and 125 of each of the valve units 111 to 114 communicate with two of the nozzle rows N1 to N8 of the recording head 9, respectively. For example, the first outlet port 124 and the second outlet port 125 of the first valve unit 111 communicate with the nozzle rows N5 and N1, respectively. The first outlet port 124 and the second outlet port 125 of the second valve unit 112 communicate with the nozzle rows N7 and N2, respectively. The first outlet port 124 and the second outlet port 125 of the third valve unit 113 communicate with the nozzle rows N6 and N3, respectively. The first outlet port 124 and the second outlet port 125 of the fourth valve unit 114 communicate with the nozzle rows N8 and N4, respectively.

Referring to FIG. 7, the housing 121 includes a first surface 121*c* and a second surface 121*d*. As shown in FIGS. 6 and 7, two first recessions 130 (only one is shown) are formed in the first surface 121*c*, and two second recessions 132 corresponding to the two first recessions 130 are formed in the second surface 121*d*.

The two first recessions 130 respectively communicate with the inlet holes 122*a* and 123*a* of the first and second inlet ports 122 and 123 through a passage 131. The two first recessions 130 respectively communicate with the second recessions 132 through two passages 133. The two second recessions 132 respectively communicate with the outlet holes 124*a* and 125*a* of the first and second outlet ports 124 and 125 through a passage 134. Accordingly, the first and second inlet ports 122 and 123 respectively communicate with the first and second outlet ports 124 and 125. A film F4 is adhered to the first surface 121*c* of the housing 121. The two first recessions 130 and the film F4 define two first reservoirs 135.

A valve member 136 is accommodated in each of the two second recessions 132. Each valve member 136 is pivotal about a pivot shaft (not shown). Each valve member 136 has a first end adjacent to the opening of the passage 133, and a second end adjacent to the film F5. The first end of the valve member 136 includes an abutment portion that closes the opening of the passage 133. The first end of the valve member 136 is urged toward the passage 133 by a spring 138, which is arranged on a boss 137 formed in the second recession 132. The abutment portion of the valve member 136 normally closes the opening of the passage 133.

A film F5 is adhered to the second surface 121*d* of the housing 121 so as to define two second reservoirs 140. In each second reservoir 140, a support plate 141 is fixed to the inner surface of the film F5. The support plate 141 abuts against the second end of the corresponding valve member 136. The support plate 141 is urged outward relative to the housing 121 by a second spring 142, which is arranged in the second recession 132. When the film F5 flexes downward, as viewed in FIG. 7, the support plate 141 presses the second end of the valve member 136. This pivots the valve member 136 in the counterclockwise direction of FIG. 7 and spaces the abutment portion at the first end of the valve member 136 from the opening of the passage 133. As a result, the passage 133 opens. When the film F5 flexes upward, the support plate 141 is spaced from the second end of the valve member 136. This pivots the valve member 136 in the clockwise direction of FIG. 7. Thus, the abutment portion at the first end of the valve member 136 closes the opening of the passage 133.

When ink is drawn into each of the first to fourth valve units 111 to 114 through the inlet holes 122*a* and 123*a* of the first and second inlet ports 122 and 123, the ink flows through the corresponding passage 131, first reservoir 135, passage 133, second reservoir 140, and passage 134. Accordingly, the ink drawn into the first and second inlet ports 122 and 123 flows out from the outlet holes 124*a* and 125*a* of the first and second outlet ports 124 and 125. More specifically, the black ink flows out from the second outlet ports 125 of the first and second valve units 111 and 112, the cyan ink flows out from the second outlet ports 125 of the third and fourth valve units 113 and 114, the magenta ink flows out from the first outlet ports 124 of the first and third valve units 111 and 113, and the yellow ink flows out from the first outlet ports 124 of the second and fourth valve units 112 and 114. As a result, the black ink is supplied to the nozzle rows N1 and N2, the cyan ink is supplied to the nozzle rows N3 and N4, the magenta ink is supplied to the nozzle rows N5 and N6, and the yellow ink is supplied to the nozzle rows N7 and N8. The printer 1 of the preferred embodiment records dots on a recording sheet by moving the carriage 8 along the guide rod 7 and ejecting ink from each of the nozzle rows N1 to N8 of the recording head 9.

When the printer 1 functions to eject ink from each of the nozzle rows N1 to N8 of the recording head 9, the ink of each color stored in the corresponding second reservoir 140 decreases in accordance with the ejected amount of ink. This decreases the pressure in the second reservoir 140. When the pressure in the second reservoir 140 decreases, the film F5 flexes toward the first surface 121*c* and the valve member 136 opens the passage 133. As a result, the second reservoir 140 is supplied with the ink of the corresponding color. When the second reservoir 140 is refilled with ink for an amount corresponding to the amount ejected from the recording head 9, the pressure in the second reservoir 140 becomes positive. As a result, the film F5 returns to its original shape and the valve member 136 shuts the passage 133. In this way, each of the first to fourth valve units 111 to 114 supplies the recording head 9 with an appropriate amount (not insufficient and not excessive) of ink of the corresponding color. This prevents the hydrodynamic flow pressure of the ink of each color from fluctuating. Therefore the hydrodynamic flow pressures of the inks are maintained at substantially constant value.

As shown in FIG. 1, a cap 151 and a suction pump 153 are arranged in the frame 2 of the printer 1. The suction pump 153 is connected to the cap 151 by a tube T. The cap 151 is driven by a raising mechanism (not shown) to come into contact with or move away from the nozzle surface 10 of the recording head 9. The cap 151 comes into contact with the nozzle surface 10 to cover the nozzle rows N1 to N8. When the cap 151 is spaced from the nozzle surface 10, the suction pump 153 draws in unnecessary ink collected in the cap 151, and discharges the ink to a waste ink tank (not shown). When the cap 151 is in contact with the nozzle surface 10, the suction pump 153 depressurizes the space formed between the cap 151 and the nozzle surface 10 to absorb ink from the nozzle rows N1 to N8.

The nozzle cleaning operation will now be described. First, the pressurizing pumps P1 and P2 stop functioning to stop the supply of ink from the cartridge holders 14*a* and 14*b*. The cap 151 then covers the nozzle surface 10 of the recording head 9, and the suction pump 153 is driven. As a result, ink in the choke valves V of the passage plates 11 and 13 is drawn out through the recording head 9, the connection terminal member 126, the first to fourth valve units 111 to 114, and the tube bundle 47. The film F2 (refer to FIG. 3) of each choke valve V flexes downward and comes into contact with the central projection 35. As a result, the first to fifth rigid passages 21 to 25 are shut, and the passages from the choke valves V to the nozzle rows N1 to N8 are depressurized. In the depressurized state, the pressurizing pumps P1 and P2 are driven again to resume the supply of ink from the cartridge holders 14*a* and 14*b*. As a result, the black ink, the cyan ink, the magenta ink, and the yellow ink quickly flow from the cartridge holders 14*a* and 14*b* through the depressurized passages to be ejected from the nozzle rows N1 to N8 of the recording head 9. Even if air bubbles are included in the first to fifth rigid passages 21 to 25 of the passage plates 11 and 13, the first to fifth flexible passages 51 to 55 of the tube bundle 47, the first to fourth branch passages 101*a* to 104*b* of the branch passage assembly 61, the first to fourth valve units 111 to 114, the connection terminal member 126, and the nozzle rows N1 to N8, the air bubbles are ejected together with the ink from the nozzle rows N1 to N8.

The operation of the printer 1 will now be described with reference to FIG. 2.

The printer 1 drives the pressurizing pumps P1 and P2 to start printing. When the pressurizing pumps P1 and P2 are driven, ink is supplied from the black cartridge B in the cartridge holder 14*a* to the first branch passages 101*a* and 101*b* of the branch passage assembly 61 through the first and second flexible passages 51 and 52 of the tube bundle 47. The supplied ink branches in the first branch passages 101*a* and 101*b*, and the hydrodynamic flow pressure is adjusted in each of the first and second valve units 111 and 112. Afterwards, the ink is supplied to the nozzle rows N1 and N2. The cyan ink in the cartridge holder 14*b* flows into the second branch passages 102*a* and 102*b* of the branch passage assembly 61 through the third flexible passage 53 of the tube bundle 47. The ink branches in the middle portion 93, and the hydrodynamic flow pressure is adjusted in each of the third and fourth valve units 113 and 114. Afterwards, the ink is supplied to the nozzle rows N3 and N4. The magenta ink flows into the third branch passages 103*a* and 103*b* of the branch passage assembly 61 through the fourth flexible passage 54 of the tube bundle 47. The ink branches in the middle portion 95, and the hydrodynamic flow pressure is adjusted in each of the first and third valve units 111 and 113. Afterwards, the ink is supplied to the nozzle rows N5 and N6. The yellow ink flows into the fourth branch passages 104*a* and 104*b* of the branch passage assembly 61 through the fifth flexible passage 55 of the tube bundle 47. The ink branches in the middle portion 97, and the hydrodynamic flow pressure is adjusted in each of the second and fourth valve units 112 and 114. Afterwards, the ink is supplied to the nozzle rows N7 and N8.

The preferred embodiment has the advantages described below.

(1) The black ink, the cyan ink, the magenta ink, and the yellow ink are supplied to the first to fourth valve units 111 to 114 through the first to fourth branch passages 101*a* to 104*b*. Each of the valve units 111 to 114 adjusts the hydrodynamic flow pressure of the ink of the corresponding color, and supplies the ink to the nozzle rows N1 to N8 of the recording head 9. The ink having adjusted hydrodynamic flow pressure is supplied to each of the nozzle rows N1 to N8. Accordingly, the printer 1 accurately ejects ink from the nozzle rows N1 to N8, and improves the reliability of recording on the recording medium.

(2) Each of the black ink, the cyan ink, the magenta ink, and the yellow ink branches and is then drawn into each of the first and second inlet ports 122 and 123 of the first to fourth valve units. This reduces the number of components of the printer 1 as compared with when supplying ink from separate ink cartridges arranged for each of the first and second inlet ports 122 and 123 of the first to fourth valve units. Thus, the printer 1 is cost-efficient. Further, the printer 1 supplies different colors of ink to the nozzles N1 to N8 and ejects the different colors of ink from the nozzles N1 and N8. Therefore, the printer 1 prints images on the recording medium with high accuracy.

(3) The first to fourth branch passages 101*a* to 104*b* are formed integrally with the case 63 of the branch passage assembly 61. The integral formation saves space and reduces the number of components of the printer 1 as compared with when the first to fourth branch passages 101*a* to 104*b* are formed as separate members. This reduces the manufacturing cost of the printer 1.

(4) The black cartridge B, the cyan cartridge C, the magenta cartridge M, and the yellow cartridge Y are pressurized using compressed air supplied from the pressurizing pumps P1 and P2 to supply ink from each cartridge. The printer 1 supplies the ink in each ink cartridge to the nozzle rows N1 to N8 through the first to fourth branch passages 101*a* to 104*b* of the branch passage assembly 61. This structure reduces the number of components of the printer 1 as compared with when an ink cartridge arranged separately for each of the nozzle rows N1 to N8 is depressurized to supply ink from the ink cartridge. As a result, the manufacturing cost of the printer 1 is reduced.

(5) The ink cartridges (B, C, M, and Y) are removable and replaceable. Further, the number of the ink cartridges is smaller than the number of the nozzle rows N1 to N8. This structure reduces the number of components of the printer 1 as compared with when one ink cartridge is required for each of the nozzle rows N1 to N8. This reduces the manufacturing cost of the printer 1.

It should be apparent to those skilled in the art that the present invention may be embodied in many other specific forms without departing from the spirit or scope of the invention. Particularly, it should be understood that the present invention may be embodied in the following forms.

The ink of each color does not have to be ejected from two of the eight nozzle rows N1 to N8 formed on the nozzle surface 10. For example, the number of the nozzle rows N1 to N8 may be increased, and the ink of each color may be ejected from three or more of the increased nozzle rows. In this case, dots with high density are formed on the recording medium, and an image is printed on the recording medium with high accuracy. The nozzle rows from which the ink of the same color is ejected may be zigzagged. In this case, dots with higher density are formed on the recording medium.

The number of the colors of ink and the number of the ink cartridges may be changed.

Ink is branched by the first to fourth branch passages 101*a* to 104*b* and supplied to each of the nozzle rows N1 to N8. The ink may also be supplied to an additional nozzle row. In this case, the first to fourth branch passages 101*a* to 104*b* may have an additional branch passage corresponding to the additional nozzle row. Such an additional branch passage may be formed for at least one of the black cartridge B, the cyan cartridge C, the magenta cartridge M, and the yellow cartridge Y, and the ink from that cartridge may be supplied to the nozzle rows through the additional branch passage.

In the preferred embodiment, the black cartridge B, the cyan cartridge C, the magenta cartridge M, and the yellow cartridge Y are pressurized by compressed air supplied from the pressurizing pumps P1 and P2 to supply ink from the cartridges. However, the black cartridge B, the cyan cartridge C, the magenta cartridge M, and the yellow cartridge Y may be arranged at positions higher than the position at which the recording head 9 is arranged to supply the ink from the cartridges by using the difference between the levels of the ink and the recording head 9.

In the preferred embodiment, the first to fourth branch passages 101*a* to 104*b* are arranged integrally in the branch passage assembly 61. However, the first to fourth branch passages 101*a* to 104*b* may be formed as separate members.

In the preferred embodiment, the liquid ejection apparatus of the present invention is embodied in the printer 1. However, the liquid ejection apparatus may be embodied in liquid ejection apparatuses for ejecting other liquids. For example, the liquid ejection apparatus may be a liquid ejection apparatus for ejecting liquids such as an electrode material and a color material for use in manufacturing a liquid crystal display (LCD), an electroluminescence (EL) display, or a surface emitting display. The liquid ejection apparatus may also be a liquid ejection apparatus for ejecting living organisms for use in manufacturing a biochip or a sample ejection apparatus such as a precision pipette.

The present examples and embodiments are to be considered as illustrative and not restrictive, and the invention is not to be limited to the details given herein, but may be modified within the scope and equivalence of the appended claims.

What is claimed is:

1. A liquid ejection apparatus for ejecting liquid contained in a liquid source, the liquid ejection apparatus comprising:

a supply passage connected to the liquid source;

a liquid ejection head connected to the supply passage and including a plurality of nozzles for ejecting the liquid, wherein the plurality of nozzles form a plurality of nozzle rows;

a plurality of branch passages, connected to the supply passage, for receiving the liquid from the supply passage and supplying the liquid to two or more of the plurality of nozzle rows; and a hydrodynamic flow pressure adjusting unit that adjusts hydrodynamic flow pressure of the liquid flowing through each branch passage.

2. The liquid ejection apparatus according to claim 1, wherein the liquid source is one of a plurality of liquid sources respectively containing different liquids, the supply passage is one of a plurality of supply passages respectively corresponding to the plurality of liquid sources, and the plurality of supply passages respectively supply the liquids to the liquid ejection head.

3. The liquid ejection apparatus according to claim 2, further comprising:

a passage formation member on which the plurality of branch passages are integrally formed.

4. The liquid ejection apparatus according to claim 1, further comprising:

a compressed air generation unit for generating compressed air, wherein the compressed air generation unit pressurizes the liquid source with the compressed air to supply the liquid from the liquid source to the supply passage.

5. The liquid ejection apparatus according to claim 1, wherein the liquid source is detachable from the supply passage.

6. A liquid ejection apparatus for use with a plurality of liquid sources respectively containing liquids, the liquid ejection apparatus comprising:

a reciprocally moveable carriage remote from the liquid sources;

a plurality of liquid passages respectively connected to the plurality of liquid sources, wherein the liquids respectively flow through the plurality of liquid passages;

a plurality of branch passages respectively connected to the plurality of liquid passages, wherein each of the liquids flows through at least two of the branch passages;

a liquid ejection head supported by the reciprocally moveable carriage and including a plurality of nozzle rows respectively connected to the plurality of branch passages, the at least two of the branch passages respectively being connected to at least two of the nozzle rows, and one of the liquids being ejected from the at least two of the nozzle rows; and a plurality of valve units supported by the reciprocally moveable carriage and respectively associated with the plurality of branch passages, wherein each of the plurality of valve units adjusts hydrodynamic flow pressure of the liquid flowing through the associated branch passage.

7. The liquid ejection apparatus according to claim 6, further comprising:

a branch passage assembly formed by the plurality of branch passages, wherein the plurality of valve units are connected between the branch passage assembly and the liquid ejection head.

8. The liquid ejection apparatus according to claim 7, wherein each of the plurality of liquid passages includes a rigid passage portion, defined in a rigid plate, and a flexible passage portion, defined in a flexible member, wherein the flexible member is connected between the rigid plate and the branch passage assembly.

9. The liquid ejection apparatus according to claim 8, wherein the plurality of liquid passages are separated from one another.

10. The liquid ejection apparatus according to claim 6, wherein the quantity of the liquid passages is equal to or greater than the quantity of the liquids, and the quantity of the branch passages is two times or more greater than the quantity of the liquid passages.

* * * * *